United States Patent [19]

O'Halloran

[11] 4,253,977

[45] Mar. 3, 1981

[54] HYDRAULIC AUTOMATIC TRANSMISSION FLUID WITH SUPERIOR FRICTION PERFORMANCE

[75] Inventor: Rosemary O'Halloran, Union, N.J.

[73] Assignee: Exxon Research & Engineering Co., Florham Park, N.J.

[21] Appl. No.: 963,036

[22] Filed: Nov. 22, 1978

[51] Int. Cl.[3] ..... C10M 1/40; C10M 1/54

[52] U.S. Cl. ..... 252/33.4; 252/42.7; 252/56 D; 252/77

[58] Field of Search ..... 252/33.4, 42.7, 56 D

[56] References Cited

U.S. PATENT DOCUMENTS

| | | | |
|---|---|---|---|
| 3,259,583 | 7/1966 | Sprague et al. | 252/75 |
| 3,382,172 | 5/1968 | Lowe | 252/56 D X |
| 3,410,801 | 11/1968 | Tunkel et al. | 252/33 X |
| 3,451,930 | 6/1969 | Mead | 252/32.7 E |
| 3,899,432 | 8/1975 | Rothert et al. | 252/32.7 E |
| 3,920,562 | 11/1975 | Foehr | 252/32.7 E |
| 3,981,813 | 9/1976 | Herder et al. | 252/75 |
| 4,010,106 | 3/1977 | Rothert | 252/32.7 E |
| 4,017,406 | 4/1977 | Brois et al. | 252/51.5 A |

*Primary Examiner*—Andrew Metz

*Attorney, Agent, or Firm*—Frank T. Johmann

[57] ABSTRACT

The friction performance of a lubricating oil composition that has been compounded to serve as a functional fluid that is particularly useful in mechanical and hydraulic units containing wet clutches, for example an automotive automatic transmission, is greatly improved by the incorporation of a combination of a friction modifier of the type comprising a straight chain alkenyl or alkyl $C_4$ to $C_{10}$ dicarboxylic acid or the reaction product of an aldehyde/tris hydroxymethyl aminomethane adduct and a long chain dicarboxylic acid anhydride such as an alpha-olefin succinic anhydride; with an overbased detergent salt such as an alkali metal salt or alkaline earth metal salt of a hydrocarbyl sulfonic acid, an alkyl phenol or a sulfurized alkyl phenol, in certain proportions.

11 Claims, 2 Drawing Figures

HYDRAULIC AUTOMATIC TRANSMISSION FLUID WITH SUPERIOR FRICTION PERFORMANCE

BACKGROUND OF THE INVENTION

1. Field of the Invention

Figure 1:
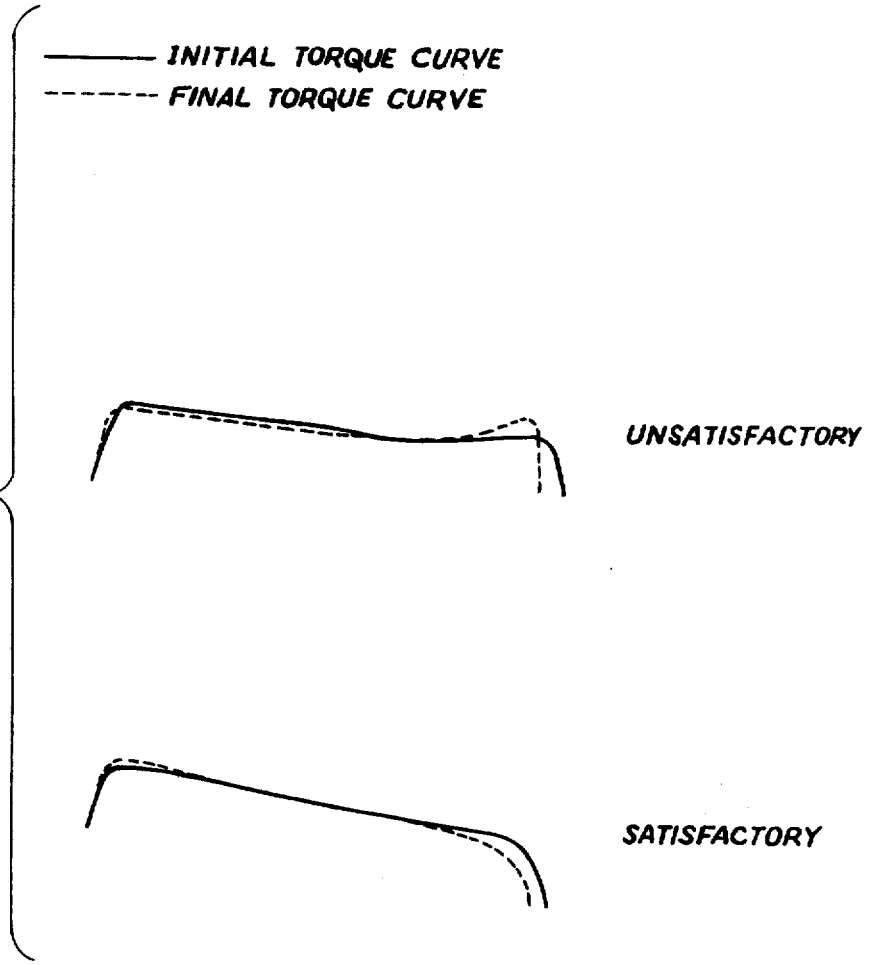

This invention relates to lubricating oil compositions that are particularly useful as functional fluids in systems that require transfer of power by fluid coupling or hydraulic action, and most particularly automatic transmissions for powered vehicles, e.g. automobiles. Automatic transmission fluids must serve a number of functions including lubrication of gears and bearings, transfer of heat, and provision of a fluid for hydraulic control and for transmitting hydraulic power. Because of the various demands placed on a fluid of this nature it is necessary that the fluid be compounded with several types of additives that will impart the desired characteristics. Among these types of additives are included viscosity index improvers, oxidation inhibitors, corrosion inhibitors, dispersants, pour point depressants, antifoaming agents, de-emulsifiers, antiwear agents, seal swellants and friction modifiers. It is obvious that all of these types of additives must be satisfactorily compatible with each other so that the presence of one type will not interfere with the desired function of another type; thus, the compounding of an acceptable automatic transmission fluid is no easy matter.

The present invention is concerned with improvements in the friction performance of a power transmission fluid that is useful in systems that rely on the frictional coupling of two or more otherwise unconnected surfaces that are immersed in or in contact with the fluid, such as in an automatic transmission. The invention involves the use of a friction modifier of a certain type in conjunction with a minor quantity of an overbased detergent salt, preferably an overbased metal hydrocarbon sulfonate, overbased metal alkyl phenate, or overbased metal salt of a sulfurized alkyl phenol, which unexpectedly enhances the friction modifying action of the friction modifier.

In an automatic transmission there are provided a turbine drive unit, a torque converter and one or more friction brakes or clutches which are engaged and disengaged automatically by an intricate hydraulic control unit. A representative clutch assembly comprises plain steel plates that come into contact with steel plates faced on both sides with a friction material such as compressed paper, impregnated with a resin. Because the clutch assembly is in contact with the transmission fluid the frictional properties of the latter have a great effect on the performance of the automatic transmission. It is most desirable that the transmission shift smoothly and that "lock-up" take place within a certain specified period of time when shifting from one transmission speed to another. It is the function of a good friction modifier to ensure that the desired performance will be attained and maintained.

A related application of functional fluids in systems employing frictional coupling is in farm tractors and other modern agricultural machines that use oil-immersed brakes and power takeoff clutches running in a common oil supply with the transmission. Here again the friction characteristics of the fluid are important so that the demands of efficient noiseless braking and power-takeoff clutch capacity can be met.

2. References To The Prior Art

There are teachings in the prior art of the use of metal salts of hydrocarbon sulfonic acids and of alkylated phenols in functional fluids such as lubricants for wet clutch systems, wet braking systems and automatic transmissions.

U.S. Pat. No. 3,410,801 describes a hydraulic fluid suitable for a wet clutch system which comprises a hydrocarbon lubricating oil containing the reaction product of an overbased metal hydrocarbon sulfonate and a fatty acid.

U.S. Pat. No. 3,451,930 teaches a lubricant for farm tractor transmissions comprising a lubricating oil containing a metal salt of a hydrocarbon sulfonic acid, a zinc salt of a dialkyl dithiophosphoric acid and chlorinated paraffin wax.

U.S. Pat. No. 3,259,583 shows a power transmission fluid consisting essentially of a major amount of a mineral lubricating oil, from about 5 to about 15 wt. % of an overbased alkaline earth metal petroleum sulfonate and minor amounts of zinc oleate and N,N'-bis(dialkyl aminophenyl) ether.

U.S. Pat. No. 3,920,562 teaches the use of a detergent amount of a metal salt of a hydrocarbon sulfonic acid in a functional fluid lubricating oil composition that also contains an alkenyl succinimide dispersant, a metal dihydrocarbyl dithiophosphate antioxidant and a friction modifying amount of a hydroxy fatty acid ester of a dihydric or polyhydric alcohol.

U.S. Pat. No. 3,899,432 discloses a functional fluid lubricating oil that is useful both as a hydraulic fluid and as a transmission and differential lubricant and which contains both a neutral metal salt of a hydrocarbyl sulfonic acid and an overbased metal salt of a hydrocarbyl sulfonic acid along with a metal salt of a dihydrocarbyl dithiophosphoric acid, tricresyl phosphate, and a sulfurized mixture of olefins and fatty acid esters.

U.S. Pat. No. 4,010,106 describes a functional fluid particularly useful in automatic transmissions which comprises a lubricating oil containing an alkenyl succinimide dispersant, a metal dihydrocarbyl dithiophosphate antioxidant, an overbased sulfurized alkaline earth metal alkyl phenate detergent-dispersant, a chlorinated olefin as a corrosion inhibitor, and a friction modifier, the latter being a certain type of fatty acid ester, fatty acid amide or fatty alkanol amine. A metal salt of a hydrocarbyl sulfonic acid may be present in conjunction with the sulfurized metal alkyl phenate.

In British Pat. No. 1,452,513 there is taught a lubricant for use in a wet brake system which comprises a lubricating oil, a detergent or a dispersant, a fatty acid, and a fatty acid amide. The detergent can be a metal organo sulfonate or a metal alkyl phenate.

A hydraulic fluid that is not intended for use in automotive transmissions but rather is designed for use in systems that are subject to contamination by sea water, such as in ships, submarines, diving rigs, underwater hydraulic tools, and the like is the subject of U.S. Pat. No. 3,981,813. The fluid comprises a hydrocarbon oil base containing four additive components, one of which is a metal hydrocarbyl sulfonate that serves as a rust and corrosion inhibitor and a sea water emulsifier. The other components are an alkyl or alkenyl succinic acid or anhydride of about 50 to 90 carbon atoms, an alkyl or alkenyl succinic acid or anhydride of about 12 to 34 carbon atoms and an ethoxylated fatty alcohol or an ethoxylated alkyl phenol.

DESCRIPTION OF THE INVENTION

In accordance with the present invention the friction performance of a lubricating oil composition that contains a friction modifier of the type that comprises an alkyl or alkenyl $C_4$ to $C_{10}$ dicarboxylic acid having a total of about 6 to about 30 carbon atoms, such as octadecyl succinic acid, or the reaction product of long chain dicarboxylic anhydride with an aldehyde/tris hydroxymethyl aminomethane adduct is greatly improved by employing that friction modifier in conjunction with an overbased alkali metal or alkaline earth metal detergent salt such as an overbased alkaline earth metal salt of a hydrocarbyl sulfonic acid an overbased alkali metal or alkaline earth metal alkyl phenate or an overbased metal salt of a sulfurized alkyl phenol. One of the benefits derived from the use of the combination of the friction modifier and the overbased detergent salt is that there is a marked improvement in static friction behavior over extended periods of time, or in other words that the usefulness of the friction modifier is given a longer life.

Figure 2:
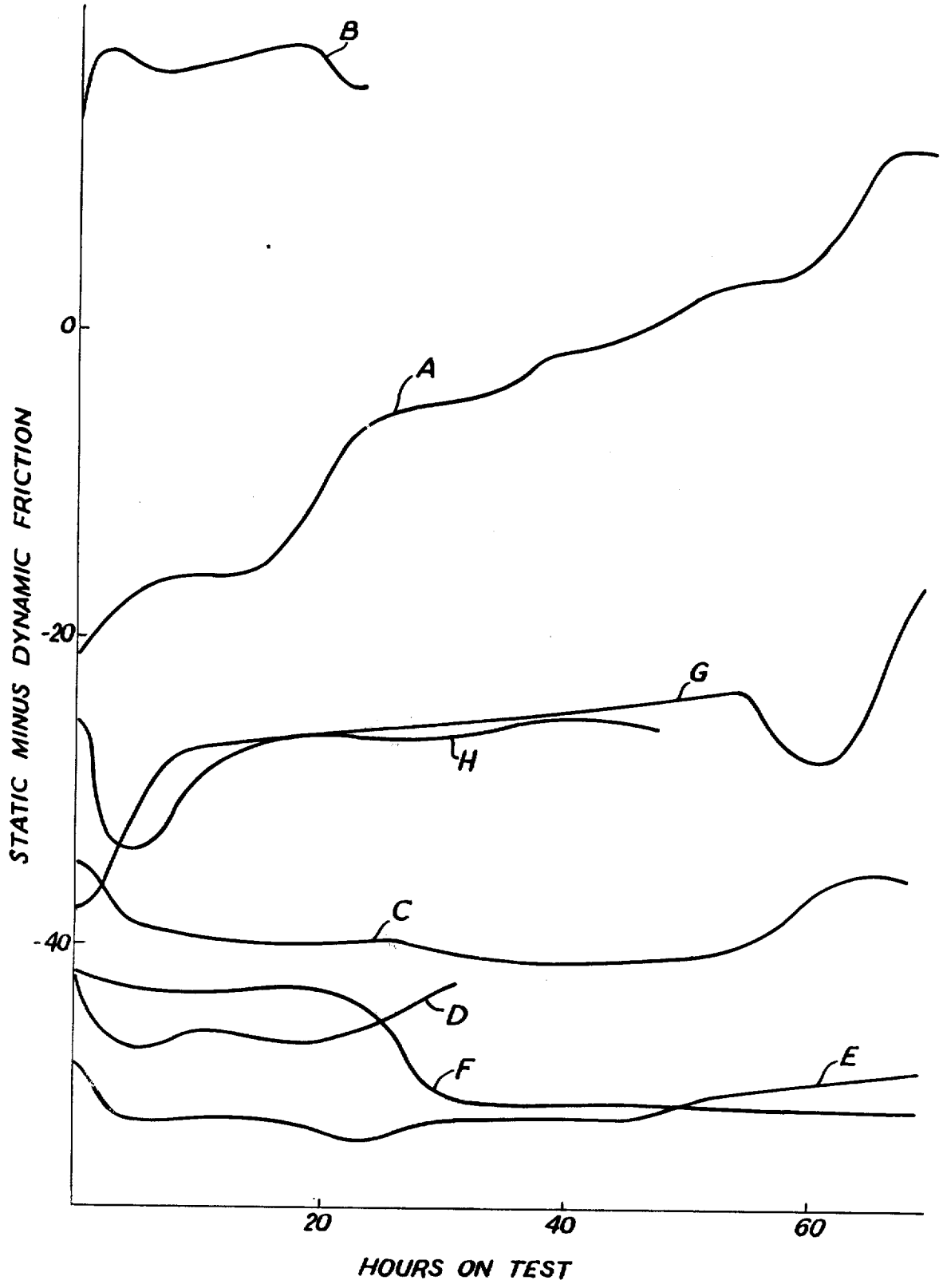

In the drawings:

FIG. 1 shows typical clutch engagement curves at the beginning and end of a friction test for, respectively, a "poor" and a "good" transmission fluid in terms of clutch plate friction; and FIG. 2 gives plots of torque curves for tests made with fluid compositions representative of the invention in comparison with test curves obtained with compositions not representative of the invention.

The overbased detergent salt that is used in the compositions of this invention is present in relatively small amounts, i.e. the quantity of overbased salt will be in the range of about 0.01 to 1.5 wt. %, preferably 0.01 to about 0.25 wt. %, more preferably about 0.02 to about 0.15 wt. %, based on the total composition.

The amount of friction modifier of the types mentioned above will range from about 0.02 to about 1.0 wt. % or preferably from about 0.1 to about 0.5 wt. % based on the total composition. The weight ratio of the friction modifier to the sulfonate or phenate will range from about 0.1 to 1 to about 10 to 1, preferably 0.25 to 1 to about 8 to 1, and most preferably about 0.5 to 1 to 6 to 1.

Alkaline earth metal salts of high molecular weight hydrocarbon sulfonic acids that have been obtained by sulfonating either natural or synthetic hydrocarbons are well known to the art. Natural hydrocarbons that are used are generally petroleum fractions, most usually lubricating oil distillate fractions, or the so-called white oil distillates, or other fractions such as petrolatum. These are converted to sulfonic acids by treatment with suitable sulfonating agents, including sulfur trioxide, concentrated sulfuric acid and fuming sulfuric acid. Synthetic hydrocarbon sulfonic acids are usually prepared by sulfonating alkylated aromatic hydrocarbons, e.g. benzene, toluene, xylene or naphthalene, that have been alkylated with wax hydrocarbons, olefins, olefin polymers, or similar sources of alkyl groups. Typically, benzene or toluene is alkylated with a polymer of propylene or of butylene, e.g. butylene trimer or propylene tetramer, or similar low olefin polymer, and the alkylate is sulfonated. The preparation of hydrocarbon sulfonic acids and their metal salts is so well known to the art that further description is not necessary here.

It is likewise not considered necessary to describe in any detail the preparation of overbased sulfonates, as such preparations are also well known to the art and the overbased sulfonates are readily available in commerce. Simply stated, the sulfonic acids are reacted with an excess of metal base and the excess metal is then usually neutralized with an acidic gas, most usually carbon dioxide.

It is similarly well known in the art to prepare overbased metal salts of alkylated phenols and of sulfurized alkyl phenols, using excess metal over the quantity needed to make neutral salts and then neutralizing the excess base with an acidic gas. One procedure for preparing a sulfurized metal alkyl phenate is to react elemental sulfur with the metal alkyl phenate at an elevated temperature. The metal salt can be overbased before sulfurizing or after sulfurizing, or at the same time. See for example, U.S. Pat. No. 3,966,621.

The sulfonic acids whose overbased metal salts are employed in the present invention will generally have molecular weights within the range of about 400 to about 1200, more usually within the range of about 400 and 800. The alkyl phenols whose overbased metal salts are employed in this invention will generally have alkyl groups with a total of about 4 to about 24 carbon atoms, or more usually from about 8 to about 18 carbon atoms, e.g. diisobutyl phenol, nonyl phenol, dinonyl phenol, or dodecyl phenol. The overbased metal sulfonates or overbased metal phenates are generally prepared in the form of oil concentrates having a total base number (TBN) of between about 100 and about 500, preferably between about 200 and about 400 (ASTM D-664), and containing about 30 to 75 wt. % active ingredient.

Other overbased metal detergent salts that can be used in this invention include overbased complexes prepared by reaction of phosphosulfurized polymeric hydrocarbons with alkaline earth metal bases in the presence of an alkyl phenol or alkyl phenol sulfide and then treating the product with carbon dioxide (see e.g. U.S. Pat. Nos. 3,182,019 and 3,127,348). Related overbased dispersions where the colloidally dispersed metal salt is a sulfate or phosphate in place of or in addition to the carbonate can also be used. Some methods of preparing the latter are shown in U.S. Pat. No. 3,644,106.

One type of friction modifier that is used in this invention is an alkyl or alkenyl $C_4$ to $C_{10}$ dicarboxylic acid having a total of from about 6 to about 30 carbon atoms in straight chain alkyl or alkenyl groups, preferably from about 10 to about 28 carbon atoms in such groups, e.g. octadecyl succinic acid, hexadecenyl succinic acid, tetradecyl adipic acid or dodecyl succinic acid.

Friction modifiers of the type comprising the half ester reaction product of an aldehyde/tris hydroxymethyl aminomethane adduct and a long chain $C_{10}$ to $C_{30}$ hydrocarbyl-substituted $C_4$ to $C_{10}$ dicarboxylic acid or anhydride are described and claimed in U.S. Pat. No. 4,017,406 of Stanley Brois, Jack Ryer and Esther Winans, issued Apr. 12, 1977. A representative example of this type of material is the half acid ester of 1-aza-3,7-dioxabicyclo[3.3.0]oct-5-yl methyl octadecenylsuccinate, obtained by the reaction of octadecenylsuccinate anhydride with 1-aza-3,7-dioxabicyclo[3.3.0]oct-5-yl methyl alcohol.

The nature of this invention will be further understood when reference is made to the following example, which includes a preferred embodiment.

EXAMPLE I

An additive blend was prepared containing about 43.42 vol. % of an ashless dispersant of the type comprising a condensation product of tetraethylene pentamine and a polyisobutenyl succinic anhydride, 2.55 vol. % phosphosulfurized alpha pinene, 2.94 vol. % of a zinc dialkyl dithiophosphate, 38.31 vol. % of V.I. improver, 3.45 vol. % of dialkyl diphenyl amine, 6.39 vol. % of dihexyl phthalate and 2.94 vol. % of commercial n-octadecyl succinic acid (OSA).

The ashless dispersant was a purchased material known as Oronite 1210 and was about a 50 wt. % concentrate of active ingredient in mineral lubricating oil. The phosphosulfurized alpha pinene contained 5.5 wt. % phosphorus and 12 wt. % sulfur. The zinc dialkyl dithiophosphate was about an 80% concentrate in oil of the zinc salts of dithiophosphoric acids obtained by $P_2S_5$ treatment of mixed $C_4$ and $C_5$ alkanols. The commercial V.I. improver (Lubrizol 3702) was an oil concentrate of about 35 wt. % of polystyrene-polymethacrylate copolymer. The dialkyl diphenyl amine was a commercial additive known as Vanlube SL and identified as p,p$^1$-dinonyl diphenyl amine.

To make a composition that would serve as an automotive automatic transmission fluid, 7.83 volumes of the described concentrate was mixed with 92.17 volumes of a solvent extracted paraffinic neutral oil of 100 SUS @100° F. viscosity. Various overbased alkaline earth metal salts of organic materials were added to portions of this compounded oil to prepare transmission fluids that exemplify the present invention. These various compositions and others of a related nature were subjected to an L-2 type friction test using a General Motors Turbo Hydramatic clutch pack THM-400 with SD-715 cellulose composition clutch plates. Test conditions were as follows:

| | |
|---|---|
| Kinetic Energy | 29000 foot pounds |
| Applied Force | 937 psi |
| Return Force | 6 psi |
| Cycle Time | 51 sec (45 on; 6 off) |
| Typical Shift | 0.8 sec |

3600 Rpm; 5000 cycles per test (approx. 69 hrs.) Vol. of fluid, 4 gal; Fluid Temp 200° F.

In the L-2 friction test the same machine is used as in the General Motors HEFCAD test (General Motors Engineering Standards GM 6137-M; Dexron II Specifications) but using the conditions outlined above. Although both dynamic and static torque measurements can be made in the test, the static torque measurements are of the greater significance.

Table 1 below shows on an active ingredient basis, the weight % of the friction modifier (FM) and the weight % of the overbased detergent salt (ODS) in the formulation of the several oil compositions tested, along with the run designations referred to in FIG. 2.

TABLE 1

| | Transmission Fluid Formulations | | |
|---|---|---|---|
| Run | Wt. % Friction Modifier | Wt. % Overbased Detergent Salt | Wt. Ratio FM/ODS |
| A | 0.23% OSA | none | — |
| B | none | .128% Mg sulfonate | — |
| C | .23% OSA | .056% Mg sulfonate | 4.1 |
| D | .23% OSA | .056% Ca sulfonate | 4.1 |
| E | .23% OSA | .076% Mg phenate | 3.0 |
| F | .23% OSA | .138% Ca phenate | 1.8 |
| G | .10% OSA | .128% Mg sulfonate | .8 |
| H | .23% OSA oxazoline | .056% Mg sulfonate | 4.1 |

In the formulations shown in Table 1 the material identified as Mg sulfonate was a purchased material known as Witco M-400 identified as hydrocarbon oil concentrate (about 40 wt. % active ingredient) of about 400 total base number containing about 25 wt. % of magnesium hydrocarbyl sulfonate of about 950 molecular weight, the overbasing component being magnesium carbonate.

The material identified as Ca sulfonate was also a purchased additive known as Witco C-300 and identified as a hydrocarbon oil concentrate (about 40 wt. % active ingredient) of about 300 total base number containing about 28 wt. % of calcium hydrocarbyl sulfonate, the hydrocarbyl portion being principally supplied by benzene alkylated with a $C_{24}$ propylene polymer. The overbasing component was calcium carbonate.

The additive identified as Ca phenate in Table 1 was a concentrate of an overbased calcium salt of sulfurized dodecyl phenol, the overbasing material being calcium carbonate, the concentrate containing 31 wt. % of mineral lubricating oil and the balance active ingredients. The concentrate had a total base number of about 250 and wt. analyzed 9.25 wt. % calcium and 3 wt. % sulfur.

The Mg phenate referred to in Table 1 was an additive concentrate of about 250 total base number containing about 40 wt. % magnesium salt of mixed monononyl and dinonyl phenol sulfides plus magnesium carbonate as the overbasing component. The concentrate analyzed 5.4 wt. % magnesium and 3.5 wt. % sulfur.

In FIG. 1 are shown typical clutch engagement curves at the beginning and end of a friction test for, respectively, a "poor" or unsatisfactory transmission fluid and a "good" or satisfactory one in terms of clutch plate friction. The solid curve in each instance is the torque curve of the clutch engagement occurring after the test had been underway for one hour, and the dotted curve is that obtained at the finish of the 70-hour test. The time elapsing during clutch engagement is about 0.8 second. It can be seen from the curves in FIG. 1 that a good or satisfactory transmission fluid gives a smooth curve at the beginning of the test, with the right side of the curve (showing static friction after clutch engagement) at a lower torque value than the left side of the curve (showing dynamic friction before clutch engagement) and that this characteristic is still present at the end of the 70-hour test. (dashed line) In a test with a "poor" or unsatisfactory transmission fluid the initial friction curve is similar to that for a satisfactory fluid, but as the test progresses the friction curve develops a peak on the static portion (right-hand side) of the curve, indicating inferior performance.

In running the L-2 friction tests with each of the compositions whose formulations are set out in Table 1 the static and dynamic torques were recorded every four hours, and the numerical difference of static minus dynamic torque was plotted against time on test, as shown in FIG. 2. A satisfactory transmission fluid will show consistently negative values throughout the test when substracting dynamic friction from static friction.

Referring now to FIG. 2, Runs A and B are for compositions where in each instance only one of the two components required in the invention was present, that is, A contains the friction modifier and not the overbased detergent salt, and B contained the overbased salt and not the friction modifier. It will be seen that composition B with only the overbased magnesium sulfonate gives a curve that starts with a peak and remains well above a zero value throughout the test. Fluid A, containing the octadecenyl succinic acid friction modifier alone, that is with no overbased detergent salt present, gives a curve that starts out with the desired negative value but then rises to a positive value as the test progresses, which is not desirable.

Compositions C, D, E, F, and G are representative examples of the present invention, comprising combinations of octadecenylsuccinic acid friction modifier with different overbased detergent salts. Composition G differs from composition C in that it uses less of the friction modifier and more of the overbased salt. The curves for the tests with these transmission fluid compositions show that all of them were satisfactory, because in each run the value of static-minus dynamic friction started well below zero and remained negative at all times during the test, thus indicating desirable soft shifting characteristics.

Composition H, which is also a representative example of this invention, employs a different friction modifier than those discussed above, this being the reaction product of octadecenylsuccinic anhydride with 1-aza-3,7-dioxabicyclo3.3.0oct-5-yl methyl alcohol. For the purpose of brevity, this friction modifier is referred to in Table 1 as OSA oxazoline. The curve for this composition in FIG. 2 shows that this friction modifier also responds well with an overbased sulfonate salt.

In brief summary, the invention relates to an automatic transmission fluid, comprising a major amount, of lubricating oil, e.g. mineral lubricating oil, and the aforesaid friction modifier and overbased metal detergent. Usually the amount of oil will be 80 wt. %, usually 90 wt. % or more of the composition. Conventional additives normally used in ATF (automatic transmission fluids) may also be present such as ashless dispersants, antioxidants, extreme pressure agents, antiwear agents, V.I. improvers, anti-corrosion agents, rubber seal swellants, etc.

It is to be understood that this invention is not to be limited by the specific embodiments herein presented. The scope of this invention is defined by the appended claims.

What is claimed is:

1. An automatic transmission fluid composition that is useful as the working and lubricating fluid for a mechanical and hydraulic automatic transmission unit containing a wet clutch, which comprises a lubricating oil composition containing from about 0.02 to about 1 wt. % of a friction modifier selected from the group consisting of: an alkyl or alkenyl $C_4$ to $C_{10}$ dicarboxylic acid having a total of from about 6 to about 30 carbon atoms in said straight chain alkyl group or alkenyl group, and the half ester reaction product of an aldehyde/tris hydroxymethyl aminomethane adduct with a long straight chain $C_{10}$ to $C_{30}$ hydrocarbyl-substituted $C_4$ to $C_{10}$ dicarboxylic acid or anhydride; and from about 0.01 to about 0.25 wt. % of an overbased alkali metal or alkaline earth metal detergent selected from the group consisting of overbased sulfonates and phenates, which enhances the friction modifying action of the friction modifier and wherein the ratio of friction modifier to overbased salt is within the limits of about 1:10 to about 10:1.

2. Composition as defined by claim 1 wherein said friction modifier is alkyl succinic acid or anhydride.

3. Composition as defined by claim 2 wherein said alkyl succinic acid or anhydride is n-octadecyl succinic acid or anhydride.

4. Composition as defined by claim 1 wherein said friction modifier is the half acid ester of 1-aza-3,7-dioxabicyclo[3.3.0]oct-5-yl methyl octadecenyl succinate.

5. Composition as defined by claim 1 wherein said overbased salt is an overbased alkaline earth metal hydrocarbyl sulfonate.

6. Composition as defined by claim 1 wherein said overbased salt is an overbased alkaline earth metal alkyl phenate.

7. Composition as defined by claim 1 wherein said overbased salt is an overbased alkaline earth metal alkyl phenate sulfide.

8. A method for operation of an automotive automatic transmission that employs frictional coupling in contact with a lubricating fluid, which comprises operating said transmission with the composition defined by claim 1 serving as the said lubricating fluid.

9. Composition according to claim 1, wherein the amount of said friction modifier is in the range of about 0.1 to 0.5 wt. %.

10. Composition according to claim 9, wherein the ratio of friction modifier to overbased metal detergent is in the range of about 0.25:1 to about 8:1.

11. Composition according to claim 10, wherein said friction modifier is octadecenyl succinic acid or anhydride, said metal of said overbased metal detergent is calcium or magnesium, and said ratio of friction modifier to overbased metal detergent is about 0.5:1 to about 6:1.

* * * * *